US011719404B2

(12) United States Patent
Mun

(10) Patent No.: US 11,719,404 B2
(45) Date of Patent: Aug. 8, 2023

(54) LAMP FOR VEHICLE AND VEHICLE INCLUDING THE SAME

(71) Applicant: HYUNDAI MOBIS CO., LTD., Seoul (KP)

(72) Inventor: Sun Kwon Mun, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/471,109

(22) Filed: Sep. 9, 2021

(65) Prior Publication Data

US 2022/0403994 A1 Dec. 22, 2022

(30) Foreign Application Priority Data

Jun. 22, 2021 (KR) ..... 10-2021-0081121

(51) Int. Cl.

| | |
|---|---|
| ***F21S 41/265*** | (2018.01) |
| ***F21S 41/32*** | (2018.01) |
| ***F21V 5/00*** | (2018.01) |
| ***F21V 5/04*** | (2006.01) |
| ***F21S 43/20*** | (2018.01) |

(Continued)

(52) U.S. Cl.

CPC ..... *F21S 41/265* (2018.01); *F21S 41/322* (2018.01); *F21S 43/20* (2018.01); *F21S 43/26* (2018.01); *F21S 43/315* (2018.01); *F21V 5/002* (2013.01); *F21V 5/003* (2013.01); *F21V 5/004* (2013.01); *F21V 5/005* (2013.01); *F21V 5/008* (2013.01); *F21V 5/043* (2013.01); *F21V 5/045* (2013.01); *F21V 7/0091* (2013.01)

(58) Field of Classification Search

CPC ..... F21S 41/265; F21S 41/27; F21S 41/285; F21S 41/322; F21S 43/26; F21S 43/20; F21S 43/315; F21V 5/045; F21V 5/002; F21V 5/003; F21V 5/004; F21V 5/005; F21V 5/043; F21V 7/0091

See application file for complete search history.

(56) References Cited

U.S. PATENT DOCUMENTS

| | | | | |
|---|---|---|---|---|
| 6,244,731 | B1 * | 6/2001 | Koiko | F21S 41/28 362/348 |
| 10,955,106 | B1 * | 3/2021 | Lee | F21S 41/635 |
| 2002/0135280 | A1 | 9/2002 | Taniuchi | |

(Continued)

FOREIGN PATENT DOCUMENTS

| | | |
|---|---|---|
| DE | 10 2005 039 808 | 3/2007 |
| DE | 10 2016 125 887 | 7/2018 |

(Continued)

OTHER PUBLICATIONS

Korean Office Action dated Jan. 16, 2023 issued in KR 10-2021-0081121.

(Continued)

*Primary Examiner* — Colin J Cattanach

(74) *Attorney, Agent, or Firm* — DLA Piper LLP (US)

(57) ABSTRACT

Disclosed is a lamp for a vehicle, the lamp including: a light source configured to emit light; and a multi facet lens (MFL) which is provided in front of the light source, and includes a plurality of facets and stepped portions formed in boundary regions between the plurality of facets. At least some of exit surfaces of the plurality of facets have a shape of a portion of an aspherical lens or an anamorphic lens.

16 Claims, 4 Drawing Sheets

(51) Int. Cl.
*F21V 7/00* (2006.01)
*F21S 43/31* (2018.01)

(56) References Cited

U.S. PATENT DOCUMENTS

| | | | | |
|---|---|---|---|---|
| 2003/0156414 | A1* | 8/2003 | Tenmyo | G02B 19/0028 362/268 |
| 2010/0002460 | A1* | 1/2010 | Rosenhahn | F21S 41/255 362/521 |
| 2011/0205748 | A1* | 8/2011 | Yatsu | F21S 41/147 362/338 |
| 2016/0265733 | A1* | 9/2016 | Bauer | F21S 41/16 |
| 2018/0187851 | A1* | 7/2018 | Hossfeld | F21S 41/365 |
| 2018/0216794 | A1* | 8/2018 | Marchal | B60Q 1/14 |
| 2018/0320852 | A1* | 11/2018 | Mandl | F21S 41/151 |
| 2020/0080704 | A1* | 3/2020 | Kim | F21S 43/241 |

FOREIGN PATENT DOCUMENTS

| | | |
|---|---|---|
| EP | 3974710 | 3/2022 |
| JP | 2017-107875 | 6/2017 |
| KR | 10-2010-0095811 | 9/2010 |
| KR | 10-2014-0069572 | 6/2014 |
| KR | 10-2017-0112320 | 10/2017 |
| KR | 10-2018-0040198 | 4/2018 |
| KR | 10-2019-0005291 | 1/2019 |
| KR | 10-2019-0064090 | 6/2019 |

OTHER PUBLICATIONS

German Office Action dated Apr. 11, 2023 issued in DE 10 2021 125 912.6.
English Language Abstract of KR 10-2014-0069572 published Jun. 10, 2014.
English Language Abstract of KR 10-2019-0064090 published Jun. 10, 2019.
English Language Abstract of KR 10-2019-0005291 published Jan. 16, 2019.
English Language Abstract of DE 10 2016 125 887 published Jul. 5, 2018.
English Language Abstract of KR 10-2010-0095811 published Sep. 1, 2010.
English Language Abstract of KR 10-2018-0040198 published Apr. 20, 2018.
English Language Abstract of EP 3974710 published Mar. 30, 2022.
English Language Abstract of KR 10-2017-0112320 published Oct. 12, 2017.
English Language Abstract of DE 10 2005 039 808 published Mar. 15, 2007.
Korean Office Action dated May 25, 2023 issued in KR 10-2021-0081121.

* cited by examiner

LAMP FOR VEHICLE AND VEHICLE INCLUDING THE SAME

CROSS-REFERENCE TO RELATED APPLICATION(S)

This application claims priority from and the benefit of Korean Patent Application No. 10-2021-0081121, filed on Jun. 22, 2021, which is hereby incorporated by reference for all purposes as if set forth herein.

TECHNICAL FIELD

Exemplary embodiments relate to a lamp for a vehicle and a vehicle including the lamp and, more particularly, to a lamp for a vehicle, which includes an MFL, and a vehicle including the lamp.

BACKGROUND

As the importance of aesthetic impression required for a vehicle increases, the demand for aesthetic impression of a lamp mounted to the vehicle also increases. Among lamps for a vehicle, particularly, a head lamp mounted to the front of a vehicle is required to have a slim structure with a small size of the lamp in a vertical direction so as to increase the aesthetic impression.

However, when the lamp has the slim structure, the luminous efficiency is likely to be deteriorated. Recently, in order to solve the above limitation, researches on lamps for a vehicle, to which multi facet lenses (MFLs) are mounted, have been actively conducted.

However, the lamps for a vehicle, to which the MFLs are mounted, have significant performance deviations between the lamps according to tolerances generated during processes of producing the MFLs, and accordingly, a glare phenomenon occurs.

SUMMARY

Exemplary embodiments of the present invention provide for minimizing tolerances generated during an MFL manufacturing process in a lamp for a vehicle to which the MFL is mounted, thereby minimizing the performance deviations between lamps and enhancing the performance of the lamp for a vehicle.

A first exemplary embodiment of the present invention provides a lamp for a vehicle, the lamp including: a light source configured to emit light; and a multi facet lens (MFL) which is provided in front of the light source, and includes a plurality of facets and stepped portions formed in boundary regions between the plurality of facets, wherein at least some of exit surfaces of the plurality of facets have a shape of a portion of an aspherical lens or an anamorphic lens.

Each of focuses in a vertical direction (V) of the plurality of facets may be provided between the light source and the MFL, and the focuses in the vertical direction (V) of some of the plurality of facets may be different from the focuses in the vertical direction (V) of others of the plurality of facets.

The focuses in the vertical direction (V) of at least some of the plurality of facets provided in an upper region of the MFL may be formed below the focuses in the vertical direction (V) of at least some of the plurality of facets provided in a lower region of the MFL.

The focus in the vertical direction (V) of any of the plurality of facets provided in an upper region of the MFL may be formed below the focus in the vertical direction (V) of any of the plurality of facets provided in a lower region of the MFL.

The focuses in the vertical direction (V) of at least some of the plurality of facets provided in an upper region of the MFL may be formed above the focuses in the vertical direction (V) of at least some of the plurality of facets provided in a lower region of the MFL.

The focus in the vertical direction (V) of any of the plurality of facets provided in an upper region of the MFL may be formed above the focus in the vertical direction (V) of any of the plurality of facets provided in a lower region of the MFL.

The lamp may further include an entrance lens which is provided between the light source and the MFL and on which light emitted from the light source is incident, wherein the light, which is emitted from the light source and arrives at an upper region of the entrance lens, arrives at a lower region of the MFL, and the light, which is emitted from the light source and arrives at a lower region of the entrance lens, arrives at an upper region of the MFL.

A focus of the upper region of the entrance lens may be formed below a focus of the lower region of the entrance lens.

Focuses in a vertical direction (V) of at least some of the plurality of facets provided in the lower region of the MFL may be formed at a position corresponding to the focus of the upper region of the entrance lens.

Focuses in the vertical direction (V) of at least some of the plurality of facets provided in the upper region of the MFL may be formed at a position corresponding to the focus of the lower region of the entrance lens.

The entrance lens may be a total internal reflection (TIR) lens.

The lamp may further include a shield which is provided between the entrance lens and the MFL and has a cut-off line formed in an upper portion thereof, wherein the cut-off line of the shield is provided at a position corresponding to an optical axis of the light source.

A focus of the upper region of the entrance lens may be formed at a position corresponding to the optical axis of the light source.

A focus of the lower region of the entrance lens may be formed above the optical axis of the light source.

Distances between the MFL and focuses in a vertical direction (V) of the plurality of facets provided in the MFL may be greater than distances between the MFL and focuses in a horizontal direction (H) of the plurality of facets provided in the MFL.

Each of focuses in a vertical direction (V) of the plurality of facets may be provided between the light source and the MFL, and the focuses in the vertical direction (V) of the plurality of facets may be the same as each other.

Distances between the MFL and focuses of the plurality of facets provided in both side portions of the MFL in a horizontal direction (H) may be greater than distances between the MFL and focuses of the plurality of facets provided in a central portion of the MFL in the horizontal direction (H).

A second exemplary embodiment of the present invention provides a vehicle including a lamp for a vehicle, wherein the lamp includes: a light source configured to emit light; and a multi facet lens (MFL) which is provided in front of the light source, and includes a plurality of facets and stepped portions formed in boundary regions between the plurality of facets, wherein at least some of exit surfaces of the plurality of facets have a shape of a portion of an aspherical lens or an anamorphic lens.

The lamp may be disposed in plurality in a left-right direction or an up-down direction.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION

Hereinafter, a lamp for a vehicle and the vehicle according to the present disclosure will be described with reference to the drawings.

Lamp for Vehicle

Figure 1:
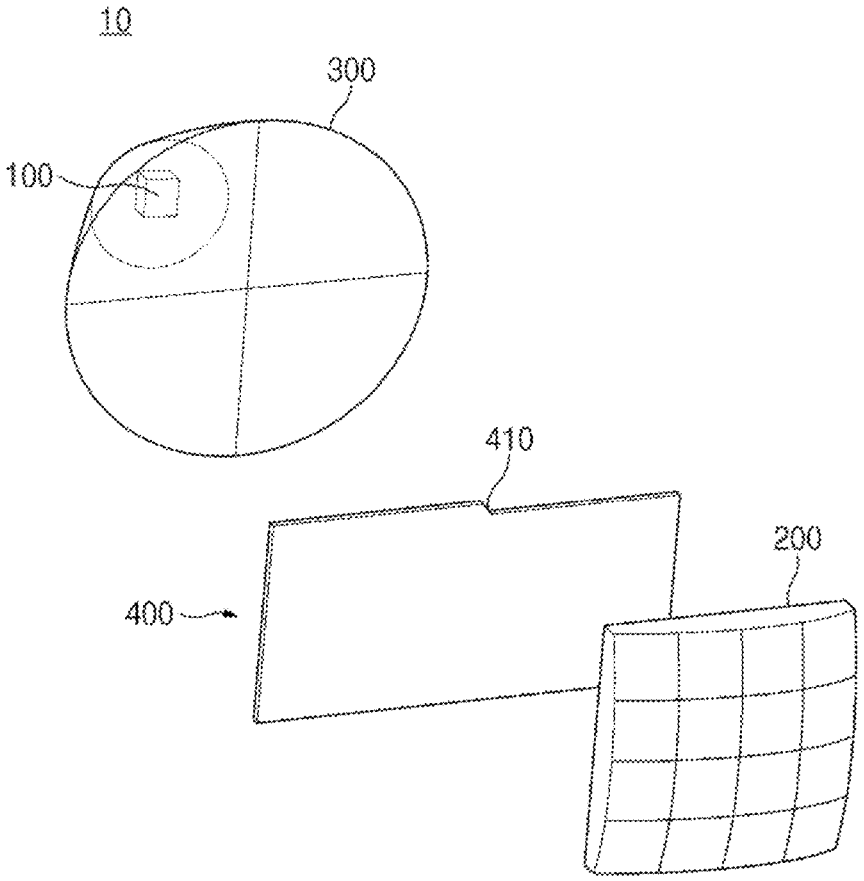
FIG. 1 is a perspective view illustrating a structure of a lamp for a vehicle according to the present disclosure.
Figure 2:
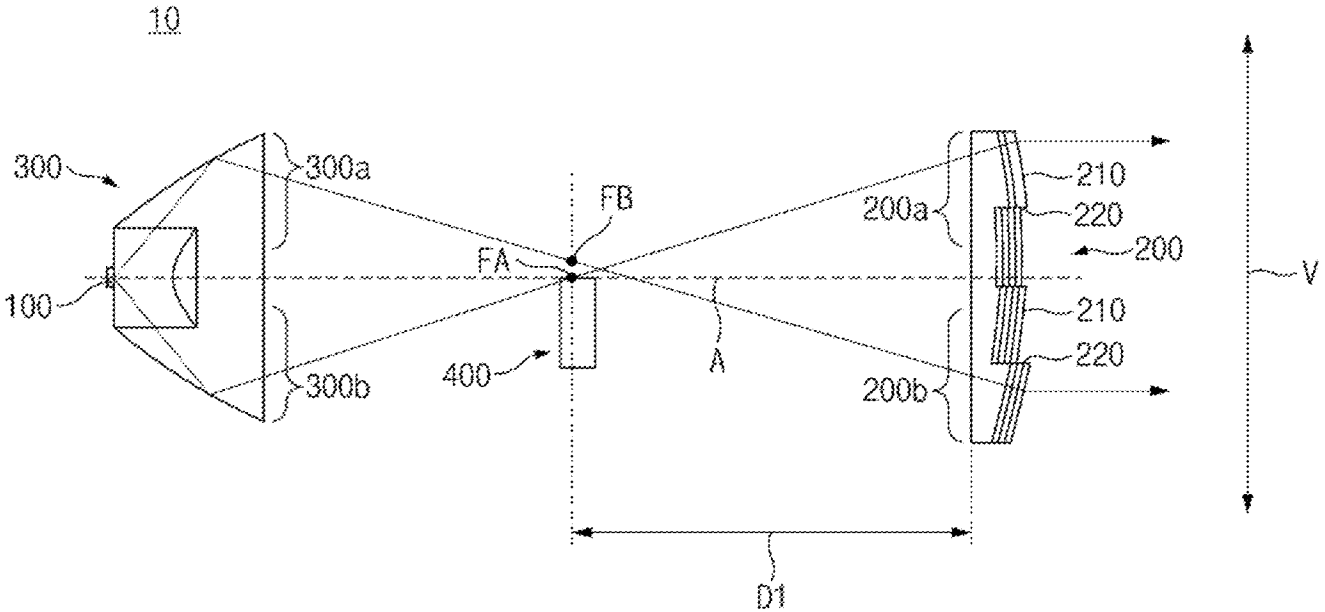
FIG. 2 is a vertical cross-sectional view illustrating a traveling path of light emitted from a light source in a lamp for a vehicle according to an exemplary embodiment of the present disclosure.
Figure 3:
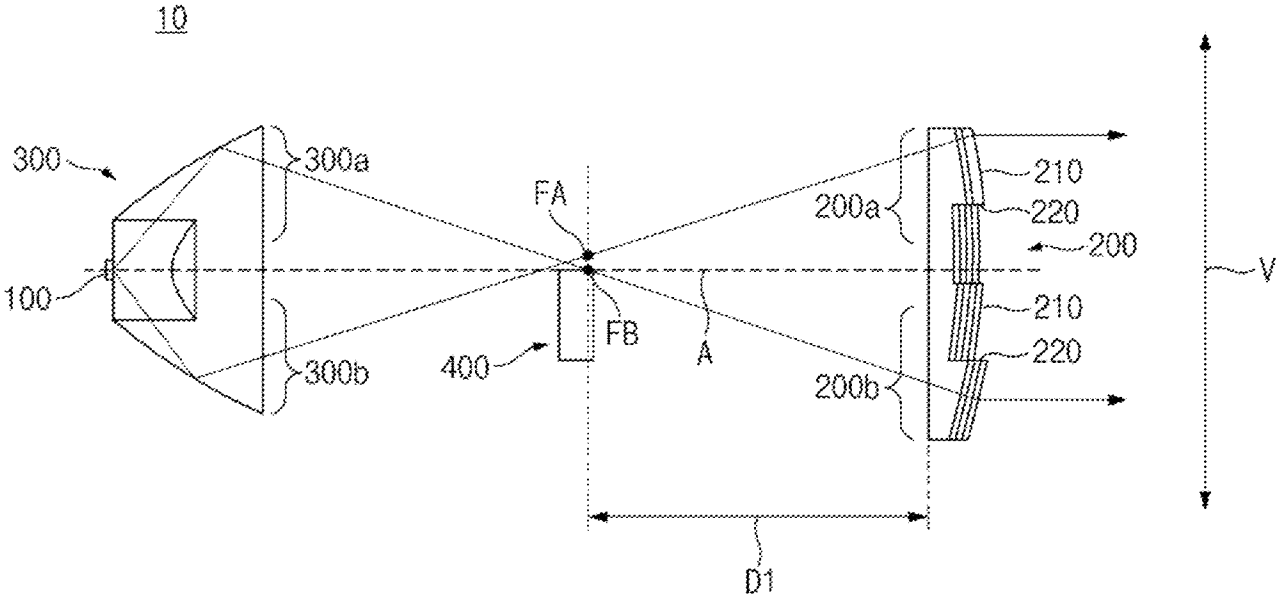
FIG. 3 is a vertical cross-sectional view illustrating a traveling path of light emitted from a light source in a lamp for a vehicle according to another exemplary embodiment of the present disclosure.
Figure 4:
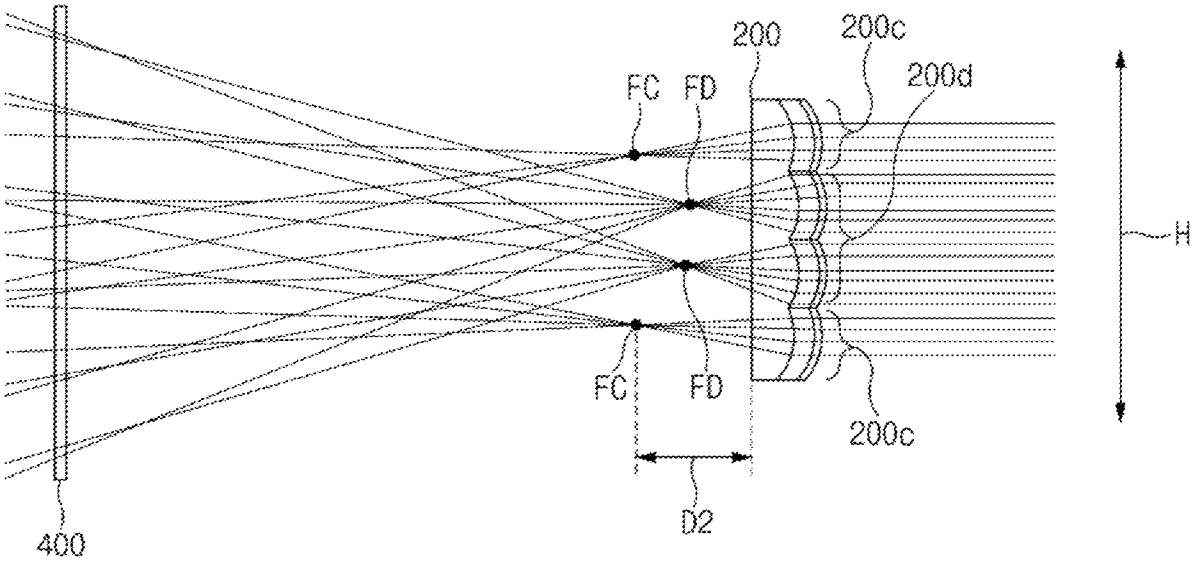
FIG. 4 is a horizontal cross-sectional view illustrating a traveling path of light emitted from a light source in a lamp for a vehicle according to the present disclosure.

FIG. 1 is a perspective view illustrating a structure of a lamp for a vehicle according to the present disclosure, and FIG. 2 is a vertical cross-sectional view illustrating a traveling path of light emitted from a light source in a lamp for a vehicle according to an exemplary embodiment of the present disclosure. Also, FIG. 3 is a vertical cross-sectional view illustrating a traveling path of light emitted from a light source in a lamp for a vehicle according to another exemplary embodiment of the present disclosure, and FIG. 4 is a horizontal cross-sectional view illustrating a traveling path of light emitted from a light source in a lamp for a vehicle according to the present disclosure.

Referring to FIGS. 1 to 4, a lamp 10 for a vehicle (hereinafter, referred to as a 'lamp') according to the present disclosure may include a light source 100 emitting light and a multi facet lens (MFL) 200 provided in front of the lamp 100. The MFL 200 may include a plurality of facets 210, and stepped portions 220 may be formed in boundary regions between the plurality of facets 210.

Meanwhile, according to the present disclosure, at least some of exit surfaces of the plurality of facets 210 provided in the MFL 200 may have a shape of a portion of an aspherical lens or an anamorphic lens. The anamorphic lens is a lens in which a focus in a horizontal direction is different from a focus in a vertical direction, and the description of the anamorphic lens will be substituted by the technical description of an anamorphic lens known from the related art.

In a lamp for a vehicle in which an MFL is provided, light, which is emitted from a plurality of facets after being emitted from a light source, respectively arrives at external specific regions, and light distribution patterns formed by the light emitted from the plurality of facets are combined together to form a predetermined beam pattern.

However, since the MFL is provided with the plurality of facets having different shapes, it is difficult to individually control tolerances of the plurality of facets during a MFL manufacturing process. Thus, according to the related art, there have been differences in performances even between lamps for a vehicle having the same structure due to tolerances of the plurality of facets provided in the MFL. Particularly, stepped portions are provided between the plurality of facets in the MFL, and significant refraction of light occurs at the stepped portions. Thus, even if a small tolerance is generated during the MFL manufacturing process, a glare phenomenon or the like occurs, and the performance of the lamp is significantly deteriorated.

However, according to the present disclosure, the exit surfaces of the plurality of facets 210 provided in the MFL 200 have a shape of a portion of an aspherical lens or an anamorphic lens, and thus the MFL 200 may be easily manufactured compared to the related art in which exit surfaces of a plurality of facets have an irregular shape. Thus, the deviation in performance between lamps 10 may be significantly reduced. Hereinafter, a structure of a lamp according to the present disclosure will be described in more detail with reference to the drawings.

As illustrated in FIGS. 2 and 3, each of focuses in a vertical direction V of the plurality of facets 210 may be provided between the light source 100 and the MFL 200, and the focuses in the vertical direction V of some of the plurality of facets 210 may be different from the focuses in the vertical direction V of others of the plurality of facets 210.

More specifically, referring to FIG. 2 according to an exemplary embodiment of the present disclosure, focuses FA in the vertical direction V of at least some of the plurality of facets 210 provided in an upper region 200*a* of the MFL 200 may be formed below focuses FB in the vertical direction V of at least some of the plurality of facets 210 provided in a lower region 200*b* of the MFL 200. More preferably, according to the exemplary embodiment of the present disclosure, a focus FA in the vertical direction V of any of the plurality of facets 210 provided in the upper region 200*a* of the MFL 200 may be formed below a focus FB in the vertical direction V of any of the plurality of facets 210 provided in the lower region 200*b* of the MFL 200.

On the other hand, referring to FIG. 3 according to another exemplary embodiment of the present disclosure, focuses FA in a vertical direction V of at least some of a plurality of facets 210 provided in an upper region 200*a* of an MFL 200 may be formed above focuses FB in the vertical direction V of at least some of a plurality of facets 210 provided in a lower region 200*b* of the MFL 200. More preferably, according to the exemplary embodiment of the present disclosure, a focus FA in the vertical direction V of any of the plurality of facets 210 provided in the upper region 200*a* of the MFL 200 may be formed above a focus FB in the vertical direction V of any of the plurality of facets 210 provided in the lower region 200*b* of the MFL 200.

As described above, according to the present disclosure, the focus FA of the facets 210 provided in the upper region 200*a* of the MFL 200 and the focus FB of the facets 210 provided in the lower region 200*b* may be spaced apart from each other in the vertical direction, and thus a light distribution pattern to be formed by the lamp 10 according to the present disclosure may be optimized, compared to a case in which the focuses of the facets provided in the upper region and the lower region of the MFL are coincident with each other.

Continuing to refer to the drawings, the lamp 10 according to the present disclosure may further include an entrance lens 300 which is provided between the light source 100 and the MFL 200 and on which light emitted from the light source 100 is incident. The entrance lens 300 may be a total internal reflection (TIR) lens, or the entrance lens 300 may be a collimator that produces parallel light. Alternatively, a lamp 10 according to the present disclosure may include, instead of the entrance lens 300, a reflector (not shown) that reflects the light emitted from the light source 100 and then emits the light to the MFL 200.

When the lamp 10 according to the present disclosure includes the entrance lens 300, the light, which is emitted from the light source 100 and arrives at an upper region 300*a* of the entrance lens 300, may arrive at the lower region 200*b* of the MFL 200, and the light, which is emitted from the light source 100 and arrives at a lower region 300*b* of the entrance lens 300, may arrive at the upper region 200*a* of the MFL 200. That is, according to the present disclosure, the light emitted from the light source 100 and arriving at the entrance lens 300 may arrive at the MFL 200 in an upside down state in the vertical direction V.

Meanwhile, according to the present disclosure, as illustrated in FIGS. 2 and 3, the focuses in the vertical direction V of at least some of the plurality of facets 210 provided in the upper region 200*a* of the MFL 200 may be formed at a position corresponding to the focus in the vertical direction V of the lower region 300*b* of the entrance lens 300. As one example, FIGS. 2 and 3 illustrate a state in which the focuses FA in the vertical direction V of at least some of the plurality of facets 210 provided in the upper region 200*a* of the MFL 200 may be coincident, in the vertical direction V, with a focus FA in the vertical direction V of the lower region 300*b* of the entrance lens 300. Meanwhile, according to the present disclosure, as illustrated in FIGS. 2 and 3, the focuses in the vertical direction V of at least some of the plurality of facets 210 provided in the lower region 200*b* of the MFL 200 may be formed at a position corresponding to the focus in the vertical direction V of the upper region 300*a* of the entrance lens 300. As one example, FIGS. 2 and 3 illustrate a state in which the focuses FB in the vertical direction V of at least some of the plurality of facets 210 provided in the lower region 200*b* of the MFL 200 may be coincident, in the vertical direction V, with a focus FB in the vertical direction V of the upper region 300*a* of the entrance lens 300.

Meanwhile, the feature in which two focuses are formed at positions corresponding to each other may be interpreted as including not only a case where the two focuses are coincident with each other but also a case where the two focuses are not coincident with each other. Here, when one of ordinary skill in the art to which this disclosure belongs examines the latter case, this case represents that the two focuses are spaced apart from each other but formed sufficiently close to each other to exhibit substantially the same effect as the case where the two focuses are coincident with each other.

Meanwhile, referring to FIG. 3, in the lamp 10 according to another exemplary embodiment of the present disclosure, a focus FB of an upper region 300*a* of an entrance lens 300 may be formed below a focus FA of a lower region 300*b* of the entrance lens 300.

Continuing to refer to FIGS. 1 to 4, the lamp 10 according to the present disclosure may further include a shield 400 which is provided between the entrance lens 300 and the MFL 200 and has a cut-off line 410 having a stepped shape and formed in an upper portion thereof.

The lamp 10 according to the present disclosure may be a lamp for a vehicle for forming a low beam light distribution pattern. The shield 400 may be configured to block a portion of the light which is emitted from the light source 100 toward the MFL 200 via the entrance lens 300 so as to form the low beam light distribution pattern described above. The cut-off line 410 may be provided at a position corresponding to an optical axis A of the light source 100. Here, the optical axis A of the light source 100 may be understood as a virtual axis which extends along a path on which the light emitted from the light source 100 travels. Meanwhile, the feature in which the cut-off line 410 is provided at the position corresponding to the optical axis A of the light source 100 may be interpreted as including not only a case where the cut-off line 410 is coincident with the optical axis A but also a case where the cut-off line 410 is spaced apart from the optical axis A. Here, when one of ordinary skill in the art to which this disclosure belongs examines the latter case, this case represents that the cut-off line 410 and the optical axis A are formed sufficiently close to each other to exhibit substantially the same effect as the case where the cut-off line 410 is coincident with the optical axis A.

Meanwhile, referring to FIG. 3, in another exemplary embodiment of the present disclosure, the focus FB of the upper region 300*a* of the entrance lens 300 may be formed at a position corresponding to an optical axis A of the light source 100. As one example, FIG. 3 illustrates a state in which the focus FB of the upper region 300*a* of the entrance lens 300 is coincident with the optical axis A. However, the feature in which the focus FB of the upper region 300*a* of the entrance lens 300 is formed at the position corresponding to the optical axis A may be interpreted as including even a case where the focus FB of the upper region 300*a* of the entrance lens 300 is spaced apart from the optical axis A. Here, when one of ordinary skill in the art to which this disclosure belongs examines the latter case, this case represents that the focus FB of the upper region 300*a* of the entrance lens 300 and the optical axis A are formed sufficiently close to each other to exhibit substantially the same effect as the case where the focus FB of the upper region 300*a* of the entrance lens 300 is coincident with the optical axis A.

On the other hand, as illustrated in FIG. 3, in another exemplary embodiment of the present disclosure, the focus FA of the lower region 300*b* of the entrance lens 300 may be formed above the optical axis A of the light source 100.

As described above, the light emitted from the light source 100 and arriving at the entrance lens 300 arrives at the MFL 200 in an upside down state in the vertical direction V. Thus, the central luminous intensity in the vicinity of the cut-off line of the low beam light distribution pattern formed according to the present disclosure is formed by the light which, among the light emitted from the light source 100, arrives at the lower region 300*b* of the entrance lens 300 and is then reflected forward. Thus, when the focus FA of the lower region 300*b* of the entrance lens 300 is formed above the optical axis A of the light source 100 as described above, a degree at which the light emitted from the lower region 300*b* of the entrance lens 300 is blocked by the shield 400 is reduced, and accordingly, the luminous efficiency of the lamp 10 according to the present disclosure may be enhanced.

Meanwhile, referring to FIGS. 2 to 4, distances D1 between the MFL 200 and the focuses FA and FB in the vertical direction V of the plurality of facets 210 provided in the MFL 200 may be greater than distances D2 between the MFL 200 and focuses FC and FD in a horizontal direction H of the plurality of facets 210 provided in the MFL 200. This may be to conform to regulations for the low beam light distribution pattern, requiring that a light distribution width in the horizontal direction H is greater than a light distribution width in the vertical direction V.

More specifically, as illustrated in FIG. 4, distances between the MFL 200 and the focuses FC of the plurality of facets 210 provided in both side portions 200*c* of the MFL 200 in the horizontal direction H may be greater than distances between the MFL 200 and the focuses FD of the plurality of facets 210 provided in a central portion 200*d* of the MFL 200 in the horizontal direction H.

Meanwhile, according to yet another exemplary embodiment of the present disclosure unlike those described above, each of focuses in a vertical direction V of a plurality of facets 210 provided in an MFL 200 is provided between a light source 100 and the MFL 200, and the focuses in the vertical direction V of the plurality of facets 210 provided in the MFL 200 may be the same as each other. This may be understood as that the focuses in the vertical direction V of the plurality of facets 210 are coincident with one focus, unlike the exemplary embodiment and another exemplary embodiment of the present disclosure described above. Except for the above feature, other features described above in the exemplary embodiment and another exemplary embodiment of the present disclosure may also be applied, in the same manner, to yet another exemplary embodiment of the present disclosure.

Hereinafter, a vehicle according to the present disclosure will be described. The features described above with respect to the lamp 10 according to the present disclosure may also be applied, in the same manner, to the vehicle according to the present disclosure which will be described below.

Vehicle

A vehicle according to the present disclosure may include a lamp 10 for a vehicle. Here, the lamp 10 may be a lamp for a low beam.

More specifically, a lamp 10 of a vehicle according to the present disclosure may include: a light source 100 which emits light; and a multi facet lens (MFL) 200 which is provided in front of the light source 100, and includes a plurality of facets 210 and stepped portions 220 formed in boundary regions between the plurality of facets 210. Also, at least some of exit surfaces of the plurality of facets 210 may have a shape of a portion of an aspherical lens or an anamorphic lens.

Meanwhile, a plurality of lamps 10 may be disposed in the vehicle according to the present disclosure. More specifically, the plurality of lamps 10 may be disposed in a left-right direction or an up-down direction.

According to the present disclosure, in the lamp for a vehicle to which the MFL is mounted, the tolerances generated during the MFL manufacturing process may be minimized, thereby minimizing the performance deviations between the lamps and enhancing the performance of the lamp for a vehicle.

Although the present disclosure has been described with specific exemplary embodiments and drawings, the present disclosure is not limited thereto, and it is obvious that various changes and modifications may be made by a person skilled in the art to which the present disclosure pertains within the technical idea of the present disclosure and equivalent scope of the appended claims.

What is claimed is:

1. A lamp for a vehicle, the lamp comprising:

a single light source configured to emit light;

a multi facet lens (MFL) which is provided in front of the light source, and comprises a plurality of facets and stepped portions formed in boundary regions between the plurality of facets, each facet comprising an exit surface, wherein at least a portion of the exit surfaces of the plurality of facets have a shape of a portion of an aspherical lens or an anamorphic lens; and an entrance lens which is provided between the light source and the MFL and on which light emitted from the light source is incident, wherein the light, which is emitted from the light source and arrives at an upper region of the entrance lens, arrives at a first facet in a lower region of the MFL, wherein the light, which is emitted from the light source and arrives at a lower region of the entrance lens, arrives at a second facet in an upper region of the MFL, the second facet being different from the first facet, wherein the entrance lens is formed as a single body, and wherein a focus of the upper region of the entrance lens is formed below a focus of the lower region of the entrance lens.

2. The lamp of claim 1, wherein each facet comprises a focus and each of the focuses is provided between the light source and the MFL, and the focuses of at least a portion of the plurality of facets are different from the focuses of others of the plurality of facets.

3. The lamp of claim 2, wherein the focuses of the at least a portion of the plurality of facets provided in an upper region of the MFL are formed below the focuses of at least some of the plurality of facets provided in a lower region of the MFL.

4. The lamp of claim 2, wherein the focus of any of the plurality of facets provided in an upper region of the MFL is formed below the focus of any of the plurality of facets provided in a lower region of the MFL.

5. The lamp of claim 2, wherein the focuses of at least some of the plurality of facets provided in an upper region of the MFL are formed above the focuses of at least some of the plurality of facets provided in a lower region of the MFL.

6. The lamp of claim 1, wherein focuses of at least a portion of the plurality of facets provided in the lower region of the MFL are formed at a position corresponding to the focus of the upper region of the entrance lens.

7. The lamp of claim 6, wherein focuses of at least a portion of the plurality of facets provided in the upper region of the MFL are formed at a position corresponding to the focus of the lower region of the entrance lens.

8. The lamp of claim 1, wherein the entrance lens is a total internal reflection (TIR) lens.

9. The lamp of claim 1, further comprising a shield which is provided between the entrance lens and the MFL and has a cut-off line formed in an upper portion thereof, wherein the cut-off line of the shield is provided at a position corresponding to an optical axis of the light source.

10. The lamp of claim 9, wherein a focus of the upper region of the entrance lens is formed at a position corresponding to the optical axis of the light source.

11. A lamp for a vehicle, the lamp comprising:

a single light source configured to emit light;

a multi facet lens (MFL) which is provided in front of the light source, and comprises a plurality of facets and stepped portions formed in boundary regions between the plurality of facets, each facet comprising an exit surface, wherein at least a portion of the exit surfaces of the plurality of facets have a shape of a portion of an aspherical lens or an anamorphic lens; and an entrance lens which is provided between the light source and the MFL and on which light emitted from the light source is incident, wherein the light, which is emitted from the light source and arrives at an upper region of the entrance lens, arrives at a first facet in a lower region of the MFL, wherein the light, which is emitted from the light source and arrives at a lower region of the entrance lens, arrives at a second facet in an upper region of the MFL, the second facet being different from the first facet, wherein the entrance lens is formed as a single body, wherein a focus of the upper region of the entrance lens is formed at a position corresponding to the optical axis of the light source, and wherein a focus of the lower region of the entrance lens is formed above the optical axis of the light source.

12. The lamp of claim 1, wherein distances between the MFL and focuses of a first portion of the plurality of facets provided in the MFL are greater than distances between the MFL and focuses of a second portion of the plurality of facets provided in the MFL.

13. The lamp of claim 1, wherein each of focuses of the plurality of facets is provided between the light source and the MFL, and the focuses of the plurality of facets are the same as each other.

14. The lamp of claim 1, wherein distances between the MFL and focuses of the plurality of facets provided in both side portions of the MFL are greater than distances between the MFL and focuses of the plurality of facets provided in a central portion of the MFL.

15. A vehicle comprising a lamp for a vehicle, wherein the lamp comprises:

a single light source configured to emit light;

a multi facet lens (MFL) which is provided in front of the light source, and comprises a plurality of facets and stepped portions formed in boundary regions between the plurality of facets, each facet comprising an exit surface, wherein at least a portion of the exit surfaces of the plurality of facets have a shape of a portion of an aspherical lens or an anamorphic lens; and an entrance lens which is provided between the light source and the MFL and on which light emitted from the light source is incident, wherein the light, which is emitted from the light source and arrives at an upper region of the entrance lens, arrives at a first facet in a lower region of the MFL, wherein the light, which is emitted from the light source and arrives at a lower region of the entrance lens, arrives at a second facet in an upper region of the MFL, the second facet being different from the first facet, wherein the entrance lens is formed as a single body, and wherein a focus of the upper region of the entrance lens is formed below a focus of the lower region of the entrance lens.

16. The vehicle of claim 15, wherein the lamp is disposed in plurality in a left-right direction or an up-down direction.

* * * * *